US006371015B1

(12) United States Patent
Tomiya

(10) Patent No.: US 6,371,015 B1
(45) Date of Patent: Apr. 16, 2002

(54) STENCIL PRINTING APPARATUS

(75) Inventor: Yoshiaki Tomiya, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/500,088

(22) Filed: Feb. 8, 2000

(30) Foreign Application Priority Data

May 18, 1999 (JP) ..... 11-136601

(51) Int. Cl.[7] ..... B41C 1/14; B41L 13/06
(52) U.S. Cl. ..... 101/128.4; 101/118
(58) Field of Search ..... 101/116–118, 128.21, 101/128.4

(56) References Cited

U.S. PATENT DOCUMENTS 5,165,338 A * 11/1992 Okazaki et al. ..... 101/118
5,207,157 A * 5/1993 Okazaki et al. ..... 101/128.4
5,224,419 A * 7/1993 Fukai ..... 101/128.4
6,070,525 A * 6/2000 Watanabe et al. ..... 101/128.21
6,076,458 A * 6/2000 Ohno ..... 101/128.4
6,125,748 A * 10/2000 Inamine ..... 101/128.4

FOREIGN PATENT DOCUMENTS

| | | |
|---|---|---|
| GB | 2 208 279 | 3/1989 |
| JP | 64-018683 | 1/1989 |
| JP | 64-024783 | 1/1989 |
| JP | 8-142470 | 6/1996 |
| JP | 9-169154 | 6/1997 |
| JP | 10-193767 | 7/1998 |

* cited by examiner

*Primary Examiner*—Stephen R. Funk
(74) *Attorney, Agent, or Firm*—Oblon, Spivak, McClelland, Maier & Neustadt, P.C.

(57) ABSTRACT

A stencil printing apparatus for printing according to the input supplied from the host machine which prepares a master for covering the open part of the plate cylinder by switching the mode when the information that there is no continuous next plate preparation image data is detected, and as the result the spoilage due to drying of the open part of the plate cylinder after printing is prevented during the printing of the next plate.

12 Claims, 6 Drawing Sheets

STENCIL PRINTING APPARATUS

CROSS REFERENCES TO RELATED APPLICATIONS

The present application is based on Japanese Priority Document Hei 11-136601 filed on May 18, 1999, the content of which is incorporated herein by reference.

BACKGROUND OF THE INVENTION

1. Field of the Invention

This invention relates to a stencil printing apparatus used in connection with an external apparatus such as a host computer.

2. Discussion of the Background

In the stencil printing apparatus, a master on which stencil pattern has been formed based on the image information of an original is wound on the peripheral surface of a porous plate cylinder having an ink supply means. A printing paper is pressed against the plate cylinder with a press member provided detachably to the peripheral surface of the plate cylinder and printing is performed.

The peripheral surface of the plate cylinder consists of the open part where several ink passage holes are formed and the non-open part where a damper disposition area is needed to clamp the end of the master. In the case of a stencil printing apparatus, which can print on printing paper with a maximum size of, for example, A3, the length of the open part of the peripheral surface of the plate cylinder is approximately 420 mm in the circumferential direction.

The master is unrolled from a roll and a printing image is formed, and the master is cut into the length corresponding to the size for covering the entire open part area, namely A3 size in the above-mentioned case regardless of the size of a printing paper to be used, and then wound on the peripheral surface of the plate cylinder.

In the stencil printing apparatus mentioned above, when the printing is finished and the original is replaced, the used master is separated from the plate cylinder with a plate cylinder separating mechanism. A newly prepared master is wound on the plate cylinder automatically. This prevents poor quality printing due to excess ink. If the used master is separated from the plate cylinder immediately after the printing is finished, the peripheral surface of the plate cylinder remains exposed to the air until a newly prepared master is wound. Before the start of the next printing, ink which has remained on the peripheral surface and/or on the open part of the plate cylinder evaporates, and the remaining ink inhibits supply of ink to the master when the next plate is printed, thus disturbing print quality.

A master having the open part length of approximately 420 mm+$\alpha$ is used for the above-mentioned stencil printing apparatus because the entire surface area of the open part must be covered and the clamping length of the clamper and the contact position of the pressing member should have enough room when A4 size printing is accomplished by using the stencil printing apparatus. About a half of the master is not used for printing forming a large margin, and the quantity of waste ink adhering on the master increases in a disadvantageous and problematic high cost manner in stencil printing.

The following technique solves the above-mentioned problem. When original information is read one by one automatically from an original reading unit for reading an original image and the image is prepared to form a plate, the last original can remain until the next printing is started. So, in order to print any original other than the last original, the length of the master to be wound is cut to correspond to the printing paper size. The pressing range is controlled to prevent the pressing member from pressing the opening part of the plate cylinder where there is no master. When a short master is wound for printing the last original, a master having sufficient length for covering the entire open part of the plate cylinder is wound regardless of the printing paper size.

As the result, the plate cylinder on which a short master is wound, remains for a long time and poor quality printing results during the next printing. Further, the consumption of the master and ink is reduced and good quality printing results.

The disadvantages of the background art are described herein.

A printing machine is connected to a host machine and printing is carried out based on the printing information supplied from the host machine. When the plate preparation image data is received from the host machine for preparation of a plate, the detection function for detecting whether the plate preparation operation now being operated is the operation of the preparation data of the last page or not, is unavailable. Further, when a master with an arbitrary length shorter than the open part of the plate cylinder is prepared, the plate cylinder on which the short master is wound remains for a long time, the ink adhered the periphery of the plate cylinder is dried, possibly causing spoilage when the next printing is started.

When the above-mentioned plate preparation image data is not prepared with an arbitrary length shorter than the open part of the plate cylinder to avoid the above-mentioned disadvantage, the consumption of master and ink increases and the printing cost concomitantly increases disadvantageously.

SUMMARY OF THE INVENTION

It is an object of the present invention to prevent the spoilage at starting of printing of a next plate. The spoilage is due to drying of the open part of the plate cylinder when printing is performed based on the printing information supplied from the host machine in the stencil printing apparatus connected to the host machine.

It is another object of the present invention to prevent high printing cost due to increased consumption of the master and ink when printing is carried out based on the printing information supplied from the host machine in the stencil printing apparatus connected to the host machine.

The present invention includes: a plate cylinder having the peripheral surface on which a master is wound and an open part for supplying ink to the wound master; a plate preparation mechanism for preparation, conveying, and cutting of the master; and a pressing mechanism for contacting/separating the pressing member onto/from the plate cylinder on which the master is wound with interposition of printing paper. The plate preparation image data is received from an external apparatus and whether there is the continuous next plate preparation image data or not is recognized during the plate preparation operation or before plate preparation operation. When the reception/recognition means recognizes that there is no continuous next plate preparation image data, the plate preparation mechanism is controllably driven so that the master is cut into a length which is sufficient for covering the entire circumferential length area of the open part of the plate cylinder and the master is wound on the plate cylinder. On the other hand, when the reception/ recognition means recognizes that there is a continuous next plate preparation image data, the plate preparation mechanism is controllably driven so that the master is cut into a length which is shorter than the circumferential length of the open part of the plate cylinder and the master is wound on the plate cylinder, and the pressing mechanism is controllably driven to restrict the contact range of the pressing member on the plate cylinder correspondingly to the length of the cut master.

The present invention viewed from another aspect includes: a plate cylinder having the peripheral surface on which a master is wound and an open part formed for supplying ink to the wound master; a plate preparation mechanism for preparation, conveying, and cutting of the master; and a pressing mechanism for contacting/separating the pressing member onto/from the plate cylinder on which the master is wound with interposition of a printing paper. The plate preparation image data is received from an external apparatus, whether there is a continuous next plate preparation image data or not is recognized during the plate preparation operation or before plate preparation operation. A conversion function to convert the plate preparation image data which the reception/recognition means receives from an external apparatus to a signal to be used for preparation of a master and a mode switching function for switching the mode so that any one of a first plate preparation printing mode and a second plate preparation printing mode is selected as the plate preparation printing mode are provided. When the first plate preparation printing mode is selected, the master having a length which is sufficient for substantially covering the entire open part of the plate cylinder is prepared; and the plate preparation mechanism is controlled so as to wind the master on the peripheral surface of the plate cylinder. On the other hand, when the second plate preparation printing mode is selected, the master having a length shorter than that of the open part of the plate cylinder is prepared and the plate preparation mechanism is controlled so as to wind the master on the peripheral surface of the plate cylinder. The contact range on the peripheral surface pressed by the pressing mechanism is controlled correspondingly to the length of the cut master; and the plate preparation printing mode is switched to the first plate preparation printing mode when the reception/recognition means recognizes that there is no continuous next plate preparation image data.

According to the present invention viewed from the further different aspect, there is provided a computer readable memory medium for storing a computer program which is installed in a computer for controlling a stencil printing apparatus having a plate cylinder with the peripheral surface on which a master is wound and an open part formed for supplying ink to the wound master, a plate preparation mechanism for preparation, conveying, and cutting of the master, a pressing mechanism for contacting/separating the pressing member onto/from the plate cylinder on which the master is wound with interposition of a printing paper, whereby the plate preparation image data is received from an external apparatus. The computer program executes; a reception recognition function for recognizing whether or not there is the continuous next plate preparation image data during the plate preparation operation or before plate preparation operation; and a control function which controllably drives a plate preparation mechanism so that the master is cut into a length which is sufficient for covering the entire circumferential length area of the open part of the plate cylinder and so that the master is wound on the plate cylinder when the reception/recognition means recognizes that there is no continuous next plate preparation image data, which controllably drives a plate preparation mechanism so that the master is cut into a length which is shorter than the circumferential length of the open part of the plate cylinder and so that the master is wound on the plate cylinder when the reception/recognition means recognizes that there is a continuous next plate preparation image data.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Embodiments of the present invention will be described in detail hereinafter.

a. Structure

Figure 1:
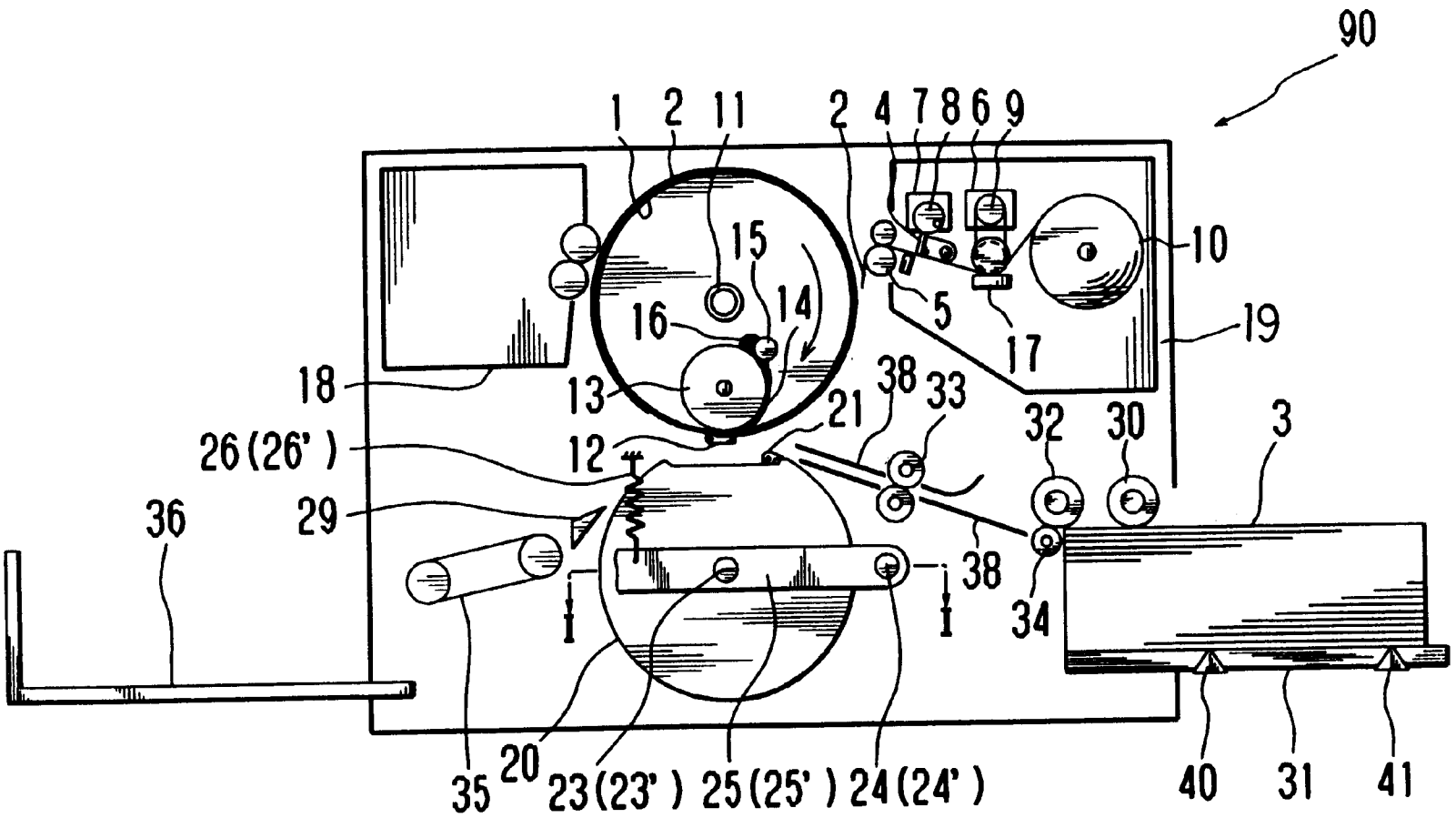
FIG. 1 is a schematic structural diagram of a stencil printing apparatus body.

A stencil printing apparatus body to which the present invention is applied is shown with a character 90 in FIG. 1. The stencil printing apparatus body refers to the mechanical structural part having a printing function, and the whole structure comprising the stencil printing apparatus body and the control function part for driving the stencil printing apparatus body is referred to as a stencil printing apparatus herein. The majority of the present invention relates to the control function part, however because the stencil printing apparatus body closely relates to the control function part as the target to be controlled, the stencil printing apparatus body is described first.

In FIG. 1, the plate cylinder 1 has a cylinder having the porous structure, and a mesh screen is wound on the periphery of the cylinder. A damper 12 which is rotatable in parallel to the axis of the plate cylinder 1 is provided on the periphery of the plate cylinder 1. Driving power is transmitted from an opening and closing unit not shown in the drawing to the damper 12, and the damper is opened/closed at the predetermined position. One end of a master 2, which is a heat sensitive stencil base paper, is clamped by the damper 12, and the other end is wound on the peripheral surface of the plate cylinder 1.

The master 2 is perforated in the plate preparation unit 19, which is a plate preparation mechanism positioned on the right side of the plate cylinder 1 in FIG. 1, based on the information of the original, and conveyed to the plate cylinder 1 by means of a base paper feeder and wound on the peripheral surface of the plate cylinder 1. The master 2 is cut into a piece having a predetermined length.

A rolled master roll 10 is held rotatably on the plate preparation unit 19. The master unrolled from the master roll 10 is conveyed while being pressed by a platen roller 9 onto a heating element part of a thermal head 17, and the master is perforated and prepared. The thermal head 17 heats the heating element part selectively based on the image signal supplied from a scanner (not shown). The prepared master 2 is cut by means of a cutter 4, which is serves as a cutting means, and conveyed to the damper 12 of the plate cylinder 1 by means of a plate feeding roller 5, which serves as a base paper feeder. Then, the master 2 reaches the damper 12, and the damper 12 catches and clamps the end of the master 2.

Figure 5:
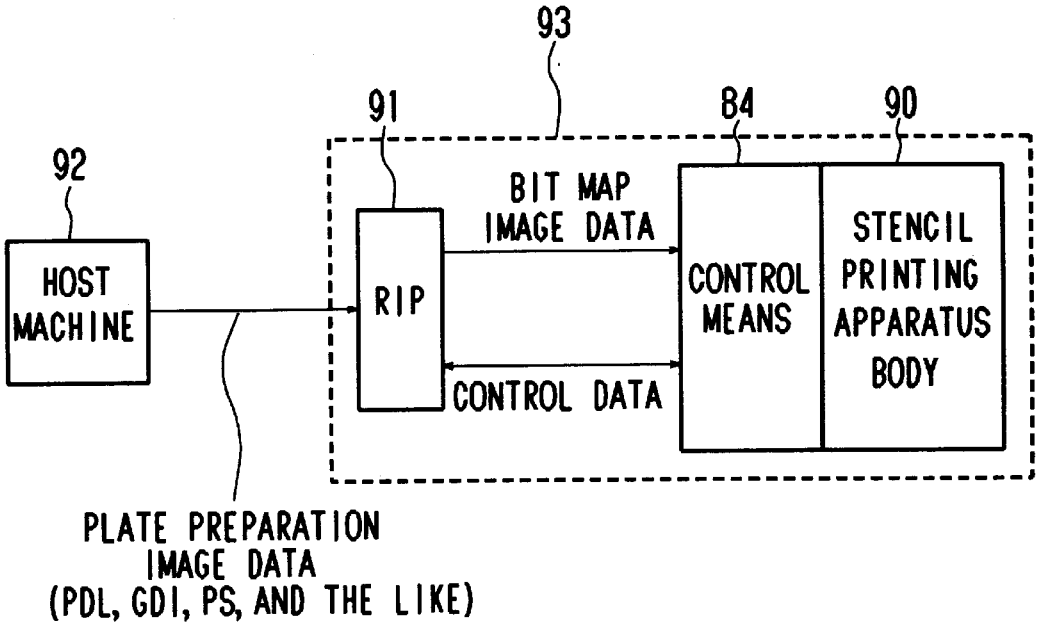
FIG. 5 is a block diagram for illustrating the structure of the present invention.

After the damper clamps the end of the master 2, the master 2 is wound on the periphery of the plate cylinder 1 with rotation of the plate cylinder 1. During the winding, the master continues to be perforated as required. The feeding magnitude of the master 2 is controlled by the platen roller driving pulse motor 6 for driving a platen roller, and when a predetermined magnitude of feeding is completed based on the indication from the control means (will be described with reference to FIG. 5 and FIG. 6) a cutter driving motor 7 for driving a cutter 4 rotates an eccentric cam 8 and the cutter 4 is moved to cut the master 2. The master 2 is wound on the periphery of the plate cylinder 1 as described herein above and thus the plate preparation and plate feeding are completed.

A plate discharging unit 18 is provided on the left side of the plate cylinder 1 in FIG. 1. After printing, the used master 2 wound on the plate cylinder 1 is separated from the plate cylinder and stored in the plate discharging unit 18. The plate cylinder 1 is rotated clock-wise by a driving unit not shown in the drawing. In the plate cylinder 1, an ink roller 13 which rotates synchronously with the plate cylinder 1 in the same direction is provided and a doctor roller 15 is provided with interposition of a small gap to the peripheral surface of the ink roller 13. The cleat-shaped facing space formed between the ink roller 13 and the doctor roller 15 is an ink duct 16. Ink 14 is supplied to the ink duct 16 through a hole of the shaft pipe 11. The ink 14 in the ink duct 16 is supplied to the peripheral surface of the ink roller 13 by means of rotation of the ink roller 13 and doctor roller 15. The ink supplied to the peripheral surface of the ink roller 13 is supplied to the inside peripheral surface of the plate cylinder 1 through a small gap between the inside peripheral surface of the plate cylinder 1 and the peripheral surface of the ink roller 13.

Under the plate cylinder 1, an impression cylinder 20 which serves as a pressing member comprising a roller-shaped rotor is positioned facing to the ink roller 13. The impression cylinder 20, which comprises a roller-shaped rotor, functions to press a printing paper 3 overlapped on the master 2 on the plate cylinder 1 against the plate cylinder 1 at the printing pressure part, which is the position on the peripheral surface of the plate cylinder 1 facing to the ink roller 13. In some cases, a so-called press roller is used instead of the impression cylinder 20. The case in which the impression roller 20 is used is described in the following example.

To avoid the collision between the impression cylinder 20 and the damper 12 on the plate cylinder 1, the part of the periphery of the impression cylinder 20 is formed flat, the impression cylinder 20 is viewed in D-shaped form from the axis direction. A gripper 21 for holding the end of the printing paper 3 is provided on the flat surface opened and closed by means of rotation. The gripper 21 is opened at a predetermined time by means of a cam (not shown), grips the end of the printing paper 3 and then closes to hold the printing paper 3 on the impression cylinder 20, and after the printing is completed, the gripper 21 is opened again at a delivery gripper 29 provided near the periphery of the impression cylinder 20, and releases the end of the printing paper 3 to deliver the end of the printing paper 3 to a paper discharging conveying unit 35 by way of the delivery gripper 29.

The impression cylinder functions by pressing the printing paper 3 to match the size of the printing paper 3, and is structured as described below so as not to press the printing paper 3 at the position where there is no printing paper 3 on the plate cylinder 1. The impression cylinder 20 has a structure for controlling the timing for contacting/separating the impression cylinder 20 in which rocking lever shafts 24 and 24' support one end side of swingable arms 25 and 25' which is swingable around the rocking lever shafts 24 and 24', the free ends of the swingable arms 25 and 25' support the impression cylinder 20 rotatably, and the swingable arms 25 and 25' are swung at the predetermined timing by cams 54 and 54' (will be described with reference to FIG. 2 and FIG. 3) which are rotated synchronously with the plate cylinder 1 to thereby contact/separate the impression cylinder 20 to/from the plate cylinder 1, and the printing paper 3 is pressed only when pressing is required.

The means for contacting/separating the impression roller 20 to/from the printing paper 3 at printing pressure part is called a pressing mechanism. The pressing mechanism comprises swingable arms 25 and 25, pressing springs 26 and 26, which are taut springs, the above-mentioned cams 54 and 54', and the impression cylinder 20. When conveying failure occurs, the impression cylinder 20 is not pressed on the plate cylinder 1, the pressure is released by means of a printing pressure releasing unit (not shown). The above-mentioned cams 54 and 54' have cam planes which correspond to the pressing length of the printing paper 3 pressed by the impression cylinder 20. The cam plane is changed to correspond to the size of the printing paper 3. The changing means will be described below.

In FIG. 1, the delivery gripper 29 for separating the printing paper 3 from the impression cylinder after printing (after ink coating), the paper delivery conveying unit 35 for conveying the separated printing paper 3, and the paper delivery table 36 for storing the printing paper 3 conveyed by the paper delivery conveying unit 35 are provided near the left under the peripheral surface of the plate cylinder 1.

Under the plate cylinder 1 in FIG. 1, the printing paper container comprising the elevator type paper feeding table 31 which can contain the printing paper 3 having the different size is provided. On the paper feeding table 31, a sensor 40 and a sensor 41 which serve as size detection means for detecting the size of the printing paper 3 contained in the paper feeding table 31 are provided. The sensor 40 is disposed at the position where the front end of the printing paper 3 is detected and the sensor 41 is disposed at the backward position from the sensor 40 with a predetermined interval. The size of the printing paper 3 contained is identified based on whether the sensor 40 only detects the existence of the printing paper 3 or both sensor 40 and sensor 41 detect the existence of the printing paper 3. The paper feeding table 31 is moved vertically by a driving unit (not shown) in the drawing while a top printing paper of the loaded printing papers 3 is held to give suitable pressing force to the duct roller so that conveying can be carried out.

The paper feeder comprises a paper feeding roller 32 supported rotatably and a duct roller 30. These rollers are linked together with an endless belt (not shown). Under the paper feeding roller 32, a separation roller 34 for preventing overlap feeding of the printing paper 3 is in contact with the paper feeding roller 32. Furthermore, forward in the printing paper feeding direction, a pair of feeding rollers 33 supported rotatably and a pair of guide plates 38 for guiding the printing paper 3 to the feeding roller nip part are provided.

The paper feeding roller 32 is rotated clockwise by a cam (not shown) which is rotated synchronously with the plate cylinder 1, by a fan-shaped gear having a cam follower which engages with the cam, and by a paper feeding roller gear to which a one way clutch is incorporated. Similarly, the under side of the feeding roller 33 is rotated counterclockwise by a cam (not shown) which is rotated synchronously with the plate cylinder 1, by a fan-shaped gear having a cam follower which engages with the cam, and by a feeding roller gear to which a one way clutch is incorporated. The feeding speed of the printing paper 3 fed by the feeding roller 33 is set to the same speed as that of the plate cylinder 1.

b. Printing paper conveying procedure

The printing paper 3 sent out by means of rotation of the paper feeding roller 32 and duct roller 30 is prevented from overlapping conveying by means of the paper feeding roller 32 and the separating roller 34, and only the top one printing paper is conveyed to the feeding rollers 33. The front end of the printing paper 3 runs against the nip part between the feeding rollers 33 and the printing paper 3 is pushed from the back, at that time a predetermined magnitude of bend is formed upward. When the bend is formed, the rotation of the paper feeding roller 32 and duct roller 30 is brought to a stop.

Then, the bend of the printing paper 3 is released by rotating the feeding roller 33 at the predetermined time so that the master 2 on the plate cylinder 1 coincides with the printing paper 3 by the cam. Further, the paper feeding roller 32 and duct roller 30 having an incorporated one way clutch which is rotatable in the paper conveying direction and is driven as the printing paper 3 is conveyed toward the impression cylinder 20. At that time, the gripper 21 in the impression cylinder 20 is opened and grips the printing paper 3. Then, the gripper 21 is closed, the impression cylinder 20 is rotated together with the printing paper 3 held on the impression cylinder 20, and the printing paper 3 is delivered to the nip part between the plate cylinder 1 and the impression cylinder 20.

At that time, the impression cylinder 20 is being pressed by means of a force of the taut pressing springs 26 and 26', and the printing paper 3 is pressed on the peripheral surface of the plate cylinder 1. When the printing paper 3 is pressed, ink which has passed through the perforated part of the master 2 mounted on the peripheral surface of the plate cylinder 1 is transferred by means of the ink roller 13, and thus printing is performed. The printing paper 3 on which the ink has been transferred is rotated together with the impression cylinder 20, and the gripper 21 opens this side of the delivery gripper 29 to separate the printing paper by means of the delivery gripper 29, the printing paper 3 is conveyed onto the paper delivery table 36 and placed on the paper delivery table 36, and the printing is finished.

c. Master cut length setting means and printing paper press length changing mechanism The above-mentioned means and mechanism are described with reference to FIG. 1 to FIG. 3. The impression cylinder 20 comprises a center shaft 23 and center shaft 23' in one piece. These center shafts 23 and 23' project from both sides in the axis direction of the impression cylinder 20, and the projections are supported with interposition of bearings 50 and 50' at the middle position of the swingable arms 25 and 25'. This structure renders the impression cylinder 20 rotatable with respect to the swingable arms 25 and 25'.

On each one end of the swingable arms 25 and 25', rocking lever shafts 24 and 24' are provided with interposition of bearings 51 and 51'. The end of the rocking lever shaft 24 is fixed to a front side plate 52. The rocking lever shaft 24' passes through the swingable arm 25' and passes through the rear side plate 52' by way of a bearing 55. In such structure, the impression cylinder 20 is supported by the swingable arms 25 and 25' which are swingable around the rocking lever shafts 24 and 24'. The reason why the impression cylinder 20 is supported by the pair of swingable arms 25 and 25' is that the impression cylinder is pressed onto the plate cylinder uniformly in the axis direction.

On the opposite side to the rocking lever shafts 24 and 24' of the swingable arms 25 and 25' namely the free end side, each one end of suppression springs 26 and 26' comprising taut springs respectively is hooked, and the other end sides are hooked on stationary members. Because of the elasticity of the pressing springs 26 and 26', a rotational force is exerted on the swingable arms 25 and 25' so that the impression cylinder 20 is rotated in the direction perpendicularly to the paper plane and toward front in FIG. 2 and FIG. 3 round the rocking lever shafts 24 and 24'. In other words, the pressing springs 26 and 26' exert the torque on the swingable arms 25 and 25' in the direction so that the impression cylinder 20 is pressed onto the plate cylinder 1.

A gear 57 is fixed to the one end side of the rocking lever shaft 24' and passes through the swingable arm 25' and the gear 57 is engaged with a gear 58 which is fixed solidly to the center shaft 23'. The rocking lever shaft 24' which passes through the rear side plate 52' is supported by the bearing 55' of the support frame 80 provided outside the rear side plate 52'. A pulley 56 is fixed to the rocking lever shaft 24' disposed between these bearings 55 and 55', and the impression cylinder 20 is rotationally driven at the same linear speed as that of the plate cylinder 1 by means of a belt hung between the pulley 56 and a driving source not shown in the drawing.

The impression cylinder 20 is required to be pressed on the plate cylinder 1 every time when printing is performed and at that time the swingable arms 25 and 25' are required to be swung repeatedly around the rocking lever shafts 24 and 24'. To perform this action smoothly, cam followers 53 and 53' are provided to each free end of the swingable arms 25 and 25', and the cam followers 53 and 53' are brought into contact with the cam plane of the cams 54 and 54' by means of elastic force of the pressing springs 26 and 26'.

These cams 54 end 54' are fixed together to the shaft 60. The cam 54 has a solid structure comprising cam plates **54*a* and 54*b* having different cam planes, and the cam plate 54*b* is positioned on the right side of the cam plate 54*a* in FIG. 2. Similarly, the cam plate 54*b*' is positioned on the right side of the cam plate 54*a*' . The cam plate 54*a* is the same as the cam plate 54*a*' in size and configuration. Similarly, the cam plate 54*b* is the same as the cam plate 54*b*' in size and configuration. The cam plate 54*a* and the cam plate 54*a*' are suitable for pressing control of the impression cylinder 20 when an A4 size printing paper 3 is used for printing. On the other hand, the cam plates 54*b* and 54*b*' are suitable for pressing control of the impression cylinder 20 when an A3 size printing paper 3** is used for printing.

The shaft 60 fixed solidly to the cams 54 and 54' is supported rotatably with interposition of a bearing 65 on the front side plate 52 and with interposition of a bearing 65' on the rear side plate 52', and slidably in the shaft longitudinal direction. A gear 66 is fixed to the projection portion of the shaft 60 projected from the bearing 65'. The gear 66 is engaged with a gear 66', the gear 66' is linked to a driving system not shown in the drawing, and the shaft 60 is rotated synchronously with the rotation of the plate cylinder 1 by means of power transmission from the driving system.

Figure 2:
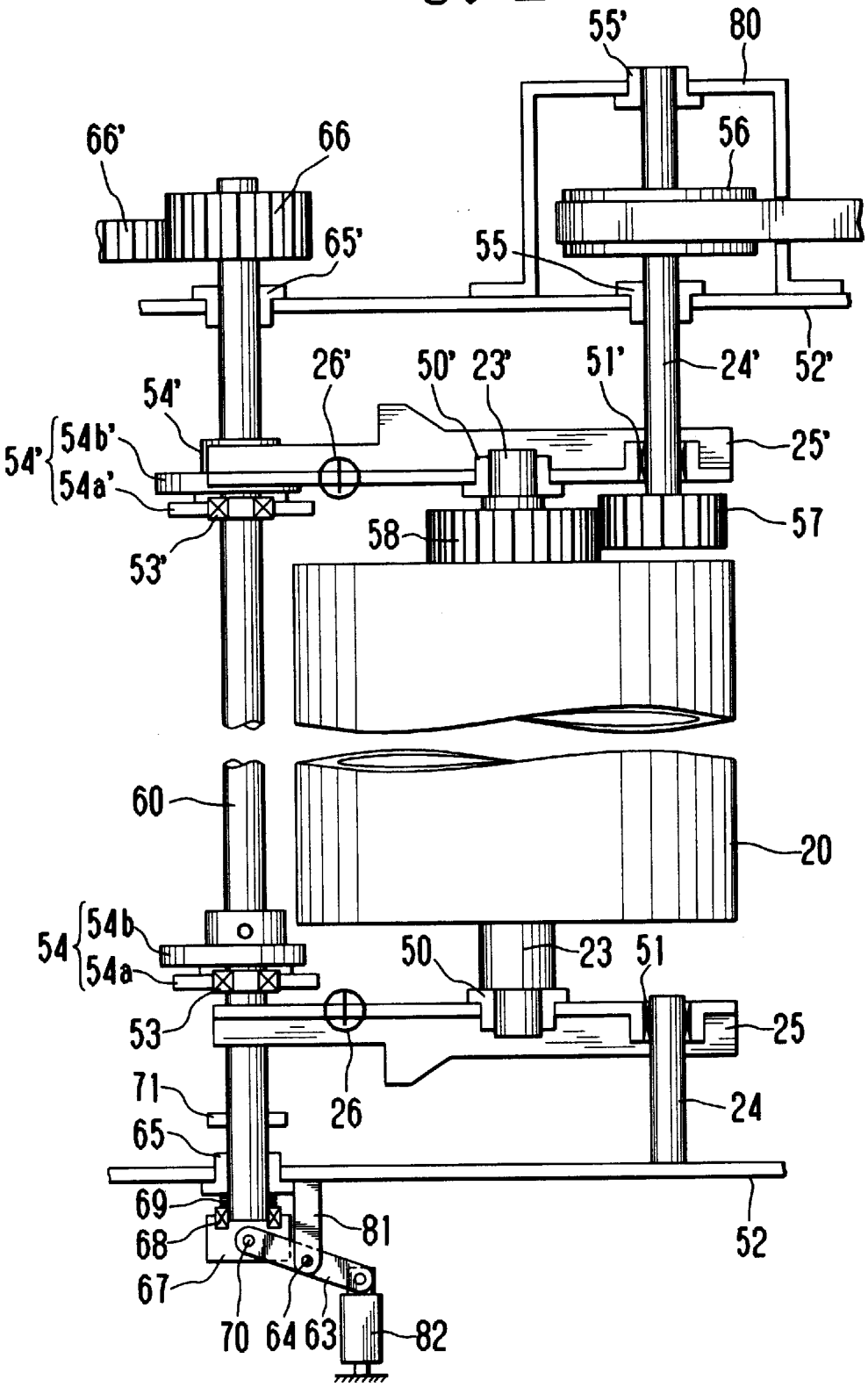
FIG. 2 is a cross sectional view along the arrow I—I in FIG. 1.
Figure 3:
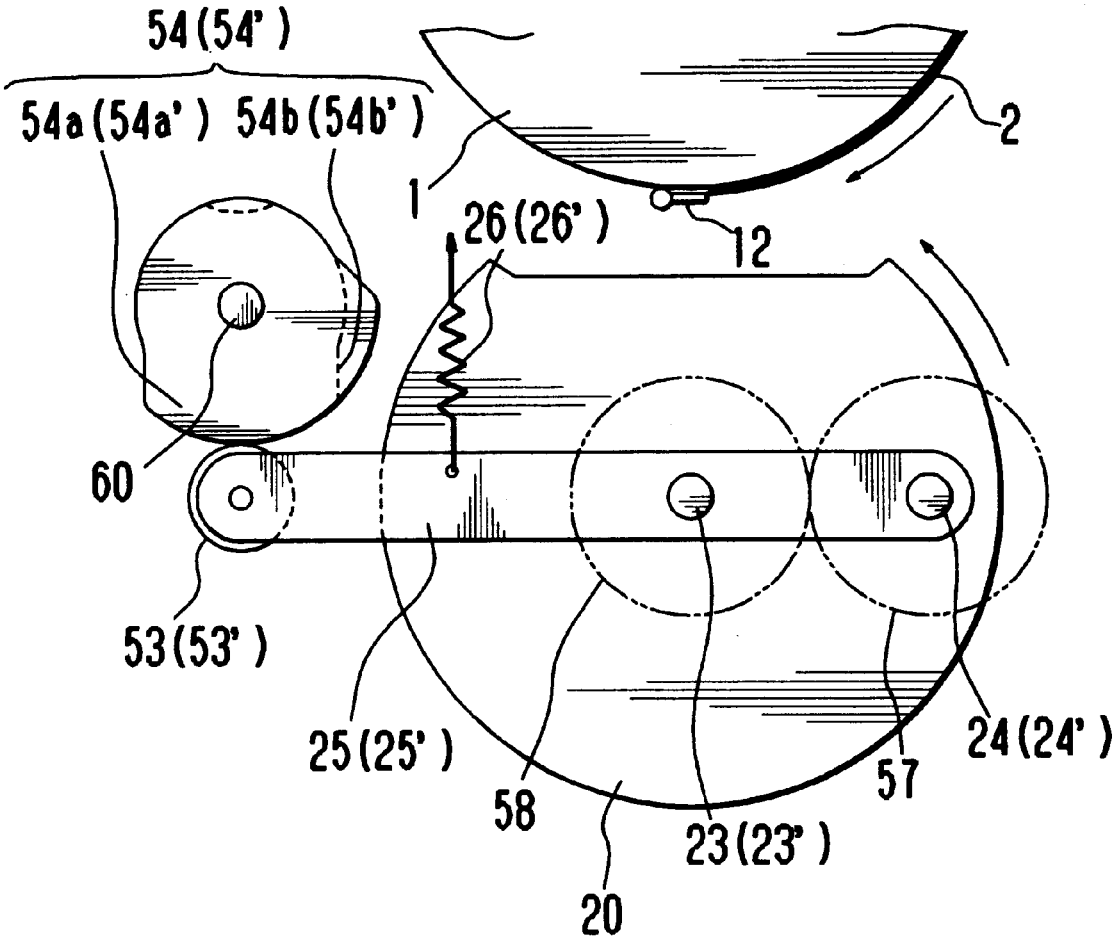
FIG. 3 is a side view of a press drum and peripheral members thereof shown in FIG. 1.

The shaft 60 is slidable in the shaft longitudinal direction, and the contact is switched between the contact of the cam followers 53 and 53' to the cam plates 54*a* and 54*a'* and the contact of the cam followers 53 and 53' to the cam plates 54*b* and 54*b'* by means of sliding. The case of the contact of cam followers 53 and 53' to the cam plates 54*a* and 54*a'* is shown in FIG. 2 and FIG. 3. Accordingly, the sliding stroke of the shaft 60 is equal to the interval size between the cam plate 54*b* and the cam plate 54*b,* and the shaft 60 may be slid by this stroke for switching between the contact of the cam plates 54*a* and 54*a'* and the contact of the cam plates 54*b* and 54*b'*. To secure the rotation of the shaft 60 during sliding of the shaft 60, the thickness of the gear 66' is prescribed to be the size equivalent to the above-mentioned sliding stroke.

As shown in FIG. 2, a bearing cover 67 is provided to the shaft end which projects from the bearing 65 of the shaft 60 with interposition of a bearing 68. The bearing cover 67 supports the shaft 60 rotatably, is in contact with the shaft end of the shaft 60, and presses the shaft 60 to move it in the shaft longitudinal direction. One end side of a swingable arm 63 is fixed to the bearing cover 67 by means of the shaft 70. The middle portion of the swingable arm 63 is joined to a support member 81 which is combined solidly with the front side plate 52 with interposition of the shaft 64. The other end side of the swingable arm 63 is joined to a plunger of a solenoid 82 fixed to a stationary member. An extension spring 69 is provided so as to be spiral on the shaft 60 between the bearing 65 and the bearing 68'. A stopper 71 is fixed on the shaft 60 between the front side plate 52 and the swingable arm 25.

Because the shaft 60 is being pressed to the left in FIG. 2 by means of the spring 69, the stopper 71 of the shaft 60 is brought into a contact with the bearing 65 due to the pressing force or the shaft 60 is stopped by the bearing cover 67 when the solenoid 82 is turned off. When the solenoid 82 is turned on, the shaft 60 is moved to the right against the elastic force, of the spring 69 as shown in FIG. 2, and the cam plates 54*a* and 54*a* ' are in contact with the cam followers 53 and 53'.

On the other hand, when the solenoid 82 is turned off, the plunger of the solenoid 82 is projected by means of the elastic force of the spring 69. Accordingly, when the solenoid 82 is turned off, the shaft 60 is moved to the left from the position shown in FIG. 2, and stopped at the position where the stopper 71 is brought into a contact with the bearing 65. At the stopping position, the cam plates 54*b* and 54*b'* are brought into a contact with the cam followers 53 and 53'. Accordingly, the contact of the cam followers 53 and 53' is switched between the contact to the cam plates 54*a* and 54*a'* and the contact to the cam plates 54*b* and 54*b'* by means of on/off control of the solenoid 82.

Figure 6:
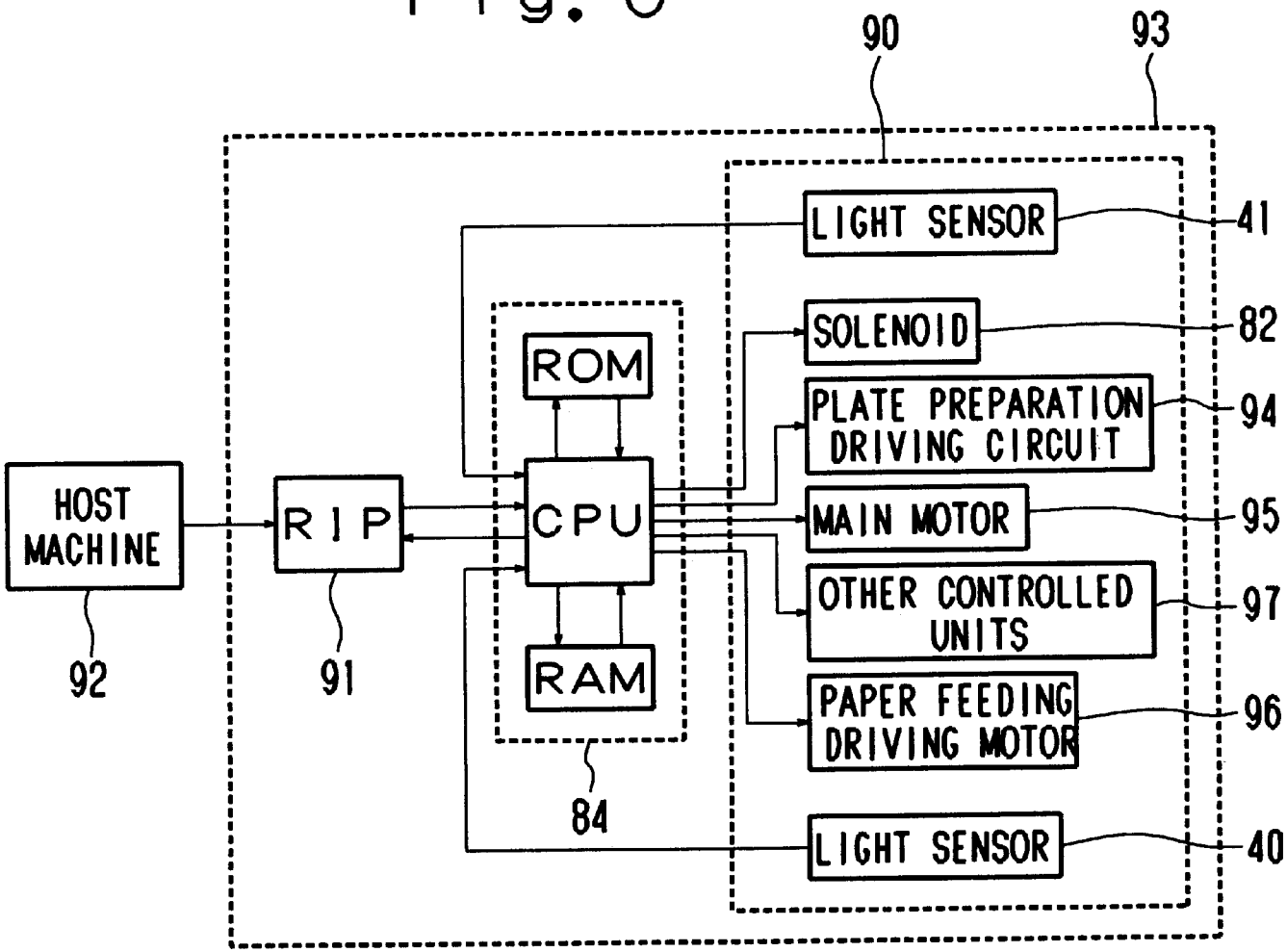
FIG. 6 is a block diagram for illustrating the structure of the present invention.

As described above, the length of the master 2 is cut so as to be matched with the length of the printing paper 3 by controlling the starting and stopping of the pulse motor 6 and the cutter driving motor 7, and the pressing length of the printing paper 3 is switched by on/off control of the solenoid 82. The pulse motor 6 and the cutter driving motor 7 are controlled so as to be started and stopped and the solenoid 82 is controlled so as to be turned on and turned off by means of the command based on the predetermined program of the control means 84 to which the output from the sensors 40 and 41 is sent out as shown in FIG. 6. The layout of the sensors 40 and 41 for detecting the size of the printing paper 3, which is the base for controlling, is described below.

d. Layout of sensors on the paper delivery table

Figure 4:
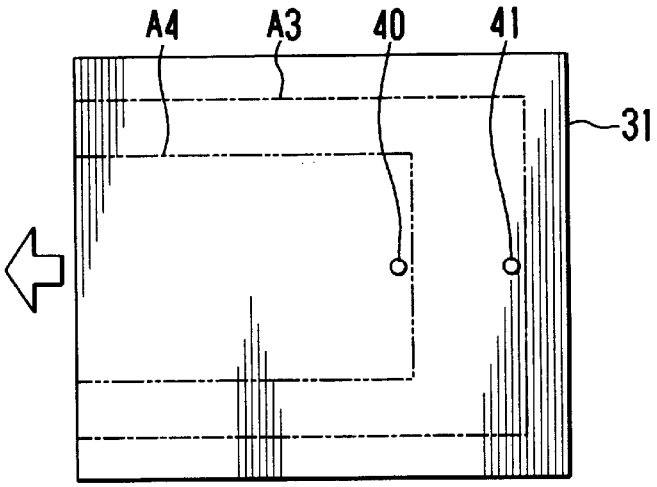
FIG. 4 is a diagram for showing the size of a printing paper placed on a paper feeding table and a sensor position.

In FIG. 4, it is assumed that printing papers on the paper delivery table 31 are contained so that ends of printing papers coincide with the left end of the paper delivery table 31 and the center of printing papers coincides with the center of the paper delivery table 31 (the center in the direction for penetrating the paper plane in FIG. 1). In other words, the printing papers are contained in a so-called center reference. The moving direction of a printing paper is indicated by a blanked arrow. In this example, there are two types of printing papers, namely, A4 vertical size and A3 vertical size which can be loaded.

In FIG. 4, "A4" and "A3" means the case in which A4 size and A3 size printing papers are loaded so that the longitudinal direction coincides with the conveying direction. Depending on the direction, the two embodiments of the type and layout of the printing paper namely "A4" and "A3" can be prescribed on the paper delivery table 31.

In this example, the sensor 40 is disposed near the left end of the paper delivery table 31 corresponding to the inside vicinity of "A4". The sensor 41 is disposed near the left end of the paper delivery table 31 corresponding to the inside vicinity of "A3". By placing the sensors as described above, one can determine whether "A4" or "A3" size printing papers are contained.

If the sensor 40 detects the existence of the printing paper, then the printing paper is determined to be A4 size, and if at least the sensor 41 detects the existence of the printing paper, then the printing paper is determined to be A3 size. According to this determination result and the data paper size from the host machine, the cutting length of the master and the pressing length of the impression cylinder are controlled.

As described above, the cutting length of the master and the pressing length of the impression cylinder are controlled in two steps. The reason why the cams 54 and 54' have two cam plates 54*a* and 54*b* and the cam plates 54*a'* and 54*b'* respectively is that this structure corresponds to the two step control.

In detail, the cam plates 54*a* and 54*a'* have the cam plane which realizes the pressing length suitable for A4 size printing paper, and the cam plates 54*b* and 54*b'* have the cam plane which realizes the pressing length suitable for A3 size printing paper.

In this example, the cutting length of the master and the pressing length of the impression cylinder are selected from two steps, but by increasing the number of positions where sensors are disposed for the size smaller than A4 and by providing cams corresponding to each size, arbitrary cutting length of the master and the pressing length of the impression cylinder are realized so as to be matched with the size of the printing paper as desired.

[2] Control System

Figure 7:
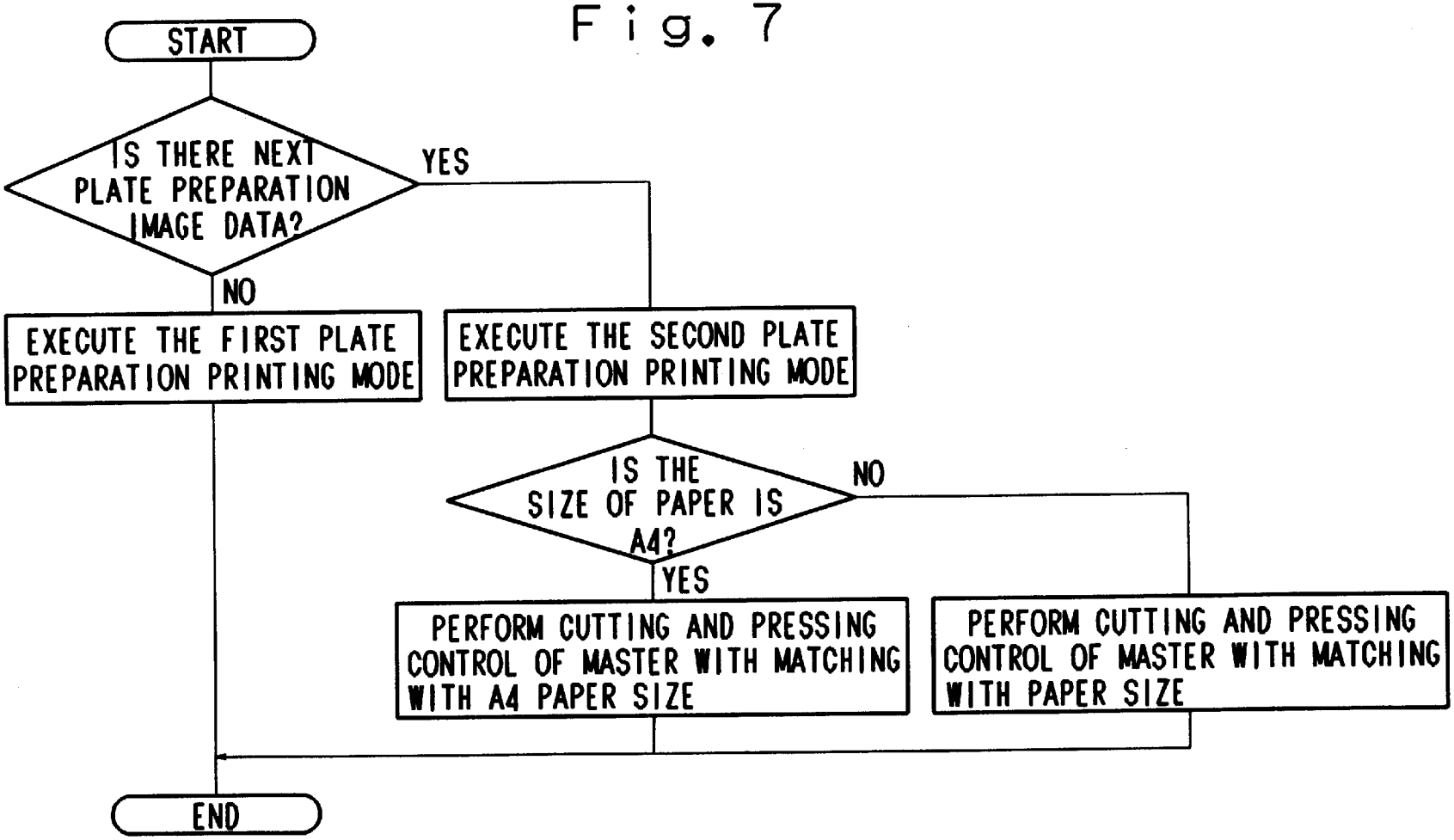
FIG. 7 is a flowchart for exemplifying a control sequence by means of a control means.

An exemplary stencil printing apparatus system is shown schematically in FIG. 6 and FIG. 7 as an example of the present invention. The control means 84 is a microcomputer mainly comprising a CPU and additionally comprising a RAM and ROM combined together, and provides a specified function executed according to a computer program stored in, for example, the ROM. The microcomputer mainly comprising the CPU and additionally comprising the combination of the RAM and ROM is built-in the stencil printing apparatus body or provided as an auxiliary component. A reception/recognition means is indicated by the character 91, in detail, the reception/recognition means is a function executed by the computer function performed by RIP (Raster Image Processor). RIP is a built-in component in the stencil printing apparatus body 90 or an auxiliary component.

The reception/recognition means 91 is a specific function executed by means of the computer function for controlling the communication hardware electrically connected to the control means 84 so as to communicate the information with the control means 84. The communication hardware controlled by the reception/recognition means 91 is electrically connected to an external host machine 92 so as to receive the information from the external host machine 92. In the present example, the stencil printing apparatus 93 comprises the reception/ recognition means 91, the control means 84, and the stencil printing apparatus body 90 for performing the functions of the respective components described above.

The memory area of the ROM stores a computer program for executing the above-mentioned various functions. The memory area is structured as a computer readable memory medium for storing the computer program. The memory medium such as a hard disk, or optical memory medium such as MO or DVD may be used instead of ROM.

The host machine 92 is a personal computer herein.

A detection signal is sent out from the sensors 40 and 41 of the stencil printing apparatus body 90 to the control means 84. Other input signals are also supplied from the stencil printing apparatus body 90, but these signals are not shown in the drawing. The control means 84 sends out control signals to the solenoid 82, the plate preparation driving circuit 94, the main motor 95, other controlled unit 97, and the paper feeding driving motor 96 in the stencil printing apparatus body 90.

The plate preparation driving circuit 94 is a circuit for plate preparation operation, and includes all the driving means such as pulse motor 6, cutter driving motor 7 and the like. The main motor 95 is a driving motor for driving the plate cylinder 1. The paper feeding driving motor 96 is a driving motor for driving the duct roller 30 and the paper feeding roller 32.

When the stencil printing apparatus 93 performs printing by use of a printing image received from the host machine 92, the host machine 92 transmits plate preparation image data to the reception/recognition means 91 by means of Page Description Language (PDL) and Graphics Device Interface (GDI).

Upon receiving the plate preparation image data, the reception/recognition means 91 converts the plate preparation image data into a raster image, stores it temporarily in the memory, and then transmits it to the control means 84 as a bit map image data. Finally, the control means 84 which has received the bit map image data converts it to a signal to be used for preparation of a master, sends out the control signal which is required for printing operation to the stencil printing apparatus body 90, and then the stencil printing apparatus body 90 starts the printing operation according to the signal. As described above, the control means 84 has a conversion function for converting the plate preparation image data which is received by the reception/recognition means 91 from the host machine 92 into the signal for preparation of the master.

The reception/recognition means 91 determines whether this plate preparation image data is that of the last page or not, or whether this plate preparation image data is the file end information in the continuous plate preparation image data or not when the reception/recognition means 91 receives the plate preparation image data from the host machine 92. The reception/recognition means 91 transmits the information that indicates whether the plate preparation image data is that of the last page or not to the control means 84 when the plate preparation is started. In the case that the reception/recognition means receives the data of the next page from the host machine while the reception/recognition means 91 is transmitting the data stored in the memory to the control means 84 (at that time, plate preparation operation of the data is being performed), the reception/recognition means 91 transmits the information for indicating that there is the next plate preparation page to the control means 84 though the stencil printing apparatus body 90 is working for preparation.

When the control means 84 recognizes that there is the next plate preparation page before or during reception of the image data from the reception/recognition means 91 as shown in FIG. 7, the control means 84 switches the plate preparation printing mode to the second plate preparation printing mode by means of mode switching function, sends out the required control signal to the stencil printing apparatus body 90, and the stencil printing apparatus body 90 performs plate preparation printing according to the control signal. In the case that the control means 84 does not recognize that there is the next plate preparation image data, this image is the last image for printing, and plate preparation printing is performed in the first plate preparation printing mode in order to avoid an exposure of the open part of the peripheral surface of the plate cylinder 1.

When the control means 84 determines that there is no next plate preparation image data as shown in FIG. 7 as described above, the first plate preparation printing mode is always performed. In detail, a master having a size matching with A3 size namely the length which covers the entire open part of the plate cylinder essentially is prepared as the master 2, the plate preparation apparatus 19 is controlled so that the master is cut into a size for matching with A3 size which covers the entire open part of the plate cylinder and so that the master is wound on the peripheral surface of the plate cylinder 1. The stencil printing apparatus body 90 is controlled so that the contact range on the peripheral surface of the plate cylinder 1 pressed by means of the pressing mechanism matches with A3 size, that is, so that the cam plates 54*b* and 54*b*' are used, and printing is performed.

Furthermore, when the control means 84 determines that there is the next plate preparation image data, the printing continues, and the master 2 is not required to have a length for covering the entire open part of the plate cylinder 1. The master 2 having the size corresponding to the printing paper size detected at that time is prepared and cut to the size of the paper even though it is shorter than the open part. The cam plate is selected so that the contact area on the peripheral surface of the plate cylinder 1 pressed by the pressing mechanism matches with the printing paper size.

In the present example, though two types of cam plates are provided as the pressing mechanism, one is for matching with A3 size and the other is for matching with A4 size, for example, a cam which is suitable for A5 size is provided additionally, and when the A5 size printing paper is detected, the master is cut into the size which matches with A5 size, and the pressing mechanism is controlled so as to be in contact with the peripheral surface of the plate cylinder 1 in the range which matches with A5 size. As described above, the present invention accommodates other arbitrary sizes.

In the printing apparatus which is provided with a plurality of paper delivery tables 31 and respective paper delivery tables 31 which contain printing papers having different sizes (A3 size, A4 size, and A5 size), the reception/recognition means 91 has the means for receiving the data paper size (A3 corresponding size, A4 corresponding size, and A5 corresponding size) of the plate preparation image data transmitted from the host machine 92. When the printing paper has been switched to the second plate preparation printing mode, the reception/recognition means 91 is controlled so that the master is cut into an arbitrary length corresponding to the data paper size and controls the control unit 19 so that the master is wound on the peripheral surface of the plate cylinder 1, and the contact area on the peripheral surface of the plate cylinder 1 pressed by the pressing mechanism is controlled correspondingly to the length of the cut master. In this case, a printing paper is fed from the paper delivery table 31 which contains the printing paper having the size corresponding to the data paper size to the printing pressure part.

As described above, in the present invention, because the open part is covered by the master when there is no next plate preparation image data during the printing in the printing performed based on the plate preparation image data supplied from the host machine, spoilage due to drying of the peripheral surface of the plate cylinder does not occur when the printing of the next plate is started. Further, because the master has a length longer that the master length required for printing is used, the problem of the increased consumption of the master and ink and the resultant high printing cost is solved.

Obviously, numerous modifications and variations of the present invention are possible in light of the above teachings. It is therefore to be understood that within the scope of the appended claims, the invention may be practiced otherwise than as specifically described herein.

What is claimed is:

1. A stencil printing apparatus comprising:

a plate cylinder having a peripheral surface on which a master is wound and an open part formed for supplying ink to said wound master;

a plate preparation mechanism for preparation, conveying, and cutting of said master;

a pressing mechanism for contacting/separating a pressing member onto/from said plate cylinder on which said master is wound with interposition of a printing paper;

reception/recognition means for receiving plate preparation image data from an external apparatus and converting said plate preparation image data to a raster image, and recognizing whether continuous next plate preparation image data is present during a plate preparation operation or before said plate preparation operation, and transmitting said plate preparation data to a control means;

wherein said control means controllably drives said plate preparation mechanism so that when said reception/recognition means recognizes that no continuous next plate preparation image data is present, said master is cut to a length which is sufficient for covering a circumferential length area of the open part of said plate cylinder and said master is wound on said plate cylinder, and when said reception/recognition means recognizes that said continuous next plate preparation image data is present, said master is cut into a length of paper which is shorter than the circumferential length of the open part of said plate cylinder and said master is wound on said plate cylinder.

2. The stencil printing apparatus according to claim 1, further comprising a paper size detection mechanism for detecting a size of said printing paper, wherein said control means, when said reception/recognition means recognizes that said continuous next plate preparation image data is present, controls said plate preparation mechanism so as to cut said master into a length corresponding to a size of the detected printing paper and to wind the cut master on said plate cylinder.

3. The stencil printing apparatus according to claim 1, wherein said reception/recognition means recognizes whether said continuous next plate preparation image data is present or not based on said plate preparation image data transmitted from said external apparatus.

4. The stencil printing apparatus according to claim 1, wherein said reception/recognition means recognizes whether said continuous next plate preparation image data is present or not based on whether said plate preparation image data of a next page is received from said external apparatus during said plate preparation operation or not.

5. The stencil printing apparatus according to claim 1, wherein said reception/recognition means recognizes a size of said printing paper based on a data paper size of said plate preparation image data transmitted from said external apparatus, and said control means controllably drives said plate preparation mechanism so that said master is cut into a length corresponding to the detected size of said printing paper when said reception/recognition means recognizes that said continuous next plate preparation image data is present.

6. The stencil printing apparatus according to claim 1, wherein said pressing mechanism comprises:

a mechanism for supporting said pressing member so as to cause said plate cylinder and said pressing member to contact each other and separate from each other;

a cam follower which is displaced together with said pressing member; and a cam plate fixed to a shaft for driving said cam plate and disposed in contact with said cam follower for restricting a contact range of said pressing member on said plate cylinder depending on said length of said cut master by displacing said pressing member with rotation of the shaft.

7. The stencil printing apparatus according to claim 1, wherein a plurality of types of cam plates having different restriction magnitudes of a contact range of said pressing member on said plate cylinder are fixed to said shaft along said shaft in a longitudinal direction, said control means selects a cam plate to be brought into contact with said cam follower by moving said shaft in an axis direction correspondingly to said size of said printing paper detected by a paper size detecting mechanism, and said contact range of said pressing member on said plate cylinder is restricted correspondingly to said length of said master which has been cut into a length corresponding to said detected size of said printing paper and wound on said plate cylinder.

8. The stencil printing apparatus according to claim 6, wherein a plurality of types of cam plates having different restriction magnitudes of a contact range of said pressing member on said plate cylinder are fixed to said shaft along said shaft in a longitudinal direction, said control means selects a cam plate to be brought into contact with said cam follower by moving said shaft in an axis direction correspondingly to a recognized size of said printing paper, and said contact range of said pressing member on said plate cylinder is restricted correspondingly to said length of said master which has been cut into a length corresponding to said recognized size of said printing paper and wound on said plate cylinder.

9. A stencil printing apparatus comprising:

a plate cylinder having a peripheral surface on which a master is wound and an open part formed for supplying ink to the wound master;

a plate preparation mechanism for preparation, conveying, and cutting of said master;

a pressing mechanism for contacting/separating a pressing member onto/from said plate cylinder on which said master is wound with interposition of a printing paper;

reception/recognition means for receiving a plate preparation image data from an external apparatus and converting said plate preparation image data to a raster image, and for recognizing whether a continuous next plate preparation image data is present or not during a plate preparation operation or before said plate preparation operation, and transmitting said plate preparation image data to a control means;

wherein said control means has a conversion function to convert said plate preparation image data which said reception/recognition means receives from said external apparatus to a signal to be used for preparation of said master and a mode switching function to switch a mode so that any one of a first plate preparation printing mode and a second plate preparation printing mode is selected as said plate preparation printing mode, and wherein said control means prepares said master with a length which is sufficient for substantially covering an entire open part of said plate cylinder and controls said plate preparation mechanism so as to wind said master on said peripheral surface of said plate cylinder when said first plate preparation printing mode is selected, and even though said master is cut to a size of said paper said master has a length shorter than that of the open part and controls said plate preparation mechanism so as to wind said master on said peripheral surface of said plate cylinder when said second plate preparation printing mode is selected, controls a contact range on said peripheral surface pressed by said pressing mechanism correspondingly to said length of the cut master, and controls so as to switch said plate preparation printing mode to said first plate preparation printing mode when said reception/recognition means recognizes that no continuous next plate preparation image data is present.

10. The stencil printing apparatus according to claim 9, further comprising a paper size detection mechanism for detecting a size of said printing paper, wherein said control means controls so that said master is cut into said length corresponding to said detected size of said printing paper while said second plate preparation printing mode is being used by means of said mode switching function, controls said plate preparation mechanism so as to wind said master on the peripheral surface of said plate cylinder, and controls said contact range on said peripheral surface of said plate cylinder pressed by said pressing member correspondingly to an arbitrary length of the cut master.

11. The stencil printing apparatus according to claim 9, wherein said reception/recognition means has a function to receive a data paper size of said plate preparation image data from a high order machine, and when said second plate preparation printing mode is used by means of said mode switching function, said control means controls so that said master is cut into a length corresponding to said data paper size, controls so that said master is wound to said peripheral surface of said plate cylinder, and controls said contact range on said peripheral surface of said plate cylinder pressed by said pressing mechanism correspondingly to said length of said cut master.

12. A computer readable memory medium for storing a computer program which is installed in a computer for controlling a stencil printing apparatus having a plate cylinder with a peripheral surface on which a master is wound and an open part formed for supplying ink to a wound master, a plate preparation mechanism for preparation, conveying, and cutting of said master, a pressing mechanism for contacting/separating a pressing member onto/from said plate cylinder on which said master is wound with interposition of a printing paper, wherein said computer program executes:

a reception recognition function for receiving a plate preparation image data from an external apparatus and converting said plate preparation image data to a raster image, and for recognizing whether a continuous next plate preparation image data is present or not during a plate preparation operation or before said plate preparation operation and transmitting said plate preparation image data to a control function;

wherein said control function controllably drives said plate preparation mechanism so that when a reception/recognition means recognizes that no continuous next plate preparation image data is present, said master is cut into a length which is sufficient for covering a circumferential length area of the open part of said plate cylinder and so that said master is wound on said plate cylinder, and when said reception/recognition means recognizes that a continuous next plate preparation image data is present, even though said master is cut to a size of said paper, said master is cut into a length which is shorter than said circumferential length of said open part of said plate cylinder and so that said master is wound on said plate cylinder.

* * * * *

UNITED STATES PATENT AND TRADEMARK OFFICE

CERTIFICATE OF CORRECTION

PATENT NO. : 6,371,015 B1
DATED : April 16, 2002
INVENTOR(S) : Yoshiaki Tomiya

It is certified that error appears in the above-identified patent and that said Letters Patent is hereby corrected as shown below:

Column 2,
Line 27, insert -- to -- between “adhered” and “the”.

Column 4,
Lines 52, 56, 56 and 59, delete “damper” and insert in its place -- clamper --.

Column 5,
Line 8, delete “serves” and insert in its place -- served --.
Lines 9, 11, 12, 13 and 60, delete “damper” and insert in its place -- clamper --.

Column 9,
Line 17, delete “54b” and insert in its place -- 54*b*’ --.

Column 14,
Line 44, delete “1” and insert in its place -- 6 --.

Signed and Sealed this

Twenty-second Day of October, 2002

*Attest:*

*Attesting Officer*

JAMES E. ROGAN
*Director of the United States Patent and Trademark Office*